US010752479B2

(12) United States Patent
Iotti

(10) Patent No.: US 10,752,479 B2
(45) Date of Patent: Aug. 25, 2020

(54) SYSTEM FOR STABILIZING SELF-PROPELLED OPERATING MACHINES

(71) Applicant: MANITOU ITALIA S.R.L., Castelfranco Emilia (Modena) (IT)

(72) Inventor: Marco Iotti, Reggio Emilia (IT)

(73) Assignee: MANITOU ITALIA S.R.L., Castelfranco Emilia (IT)

( * ) Notice: Subject to any disclaimer, the term of this patent is extended or adjusted under 35 U.S.C. 154(b) by 270 days.

(21) Appl. No.: 16/028,048

(22) Filed: Jul. 5, 2018

(65) Prior Publication Data

US 2019/0010036 A1 Jan. 10, 2019

(30) Foreign Application Priority Data

Jul. 7, 2017 (IT) ..... 102017000076727

(51) Int. Cl.
*B66F 9/075* (2006.01)
*B66F 9/065* (2006.01)
*B66C 23/80* (2006.01)

(52) U.S. Cl.
CPC ..... *B66F 9/07559* (2013.01); *B66C 23/80* (2013.01); *B66F 9/0655* (2013.01)

(58) Field of Classification Search
CPC ..... G01C 23/00; G01C 9/00; G01C 21/32; G01C 21/3446; B66C 1/108; B66C 23/185; B66C 23/525; B66C 23/54
USPC ..... 33/286
See application file for complete search history.

(56) References Cited

U.S. PATENT DOCUMENTS 3,958,813 A * 5/1976 Carey ..... B66C 23/80 280/755
4,124,226 A 11/1978 Phillips
4,244,599 A * 1/1981 Gauchet ..... E02F 9/085 280/764.1

(Continued)

FOREIGN PATENT DOCUMENTS

EP 3031769 A1 6/2016
WO 2014162191 A1 10/2014

*Primary Examiner* — Yaritza Guadalupe-McCall
(74) *Attorney, Agent, or Firm* — Pearne & Gordon LLP

(57) ABSTRACT

Described is a system for stabilizing a self-propelled operating machine (1), comprising scissor-like stabilizers (10), designed to pass from operating configurations, in which they stabilize the machine (1), thereby raising the wheels (22) above the ground, to a rest configuration, in which the wheels (11) are returned to the ground, in turn comprising: one or more pairs of rotatable stabilizing telescopic arms (2), each arm (2) comprising a first segment (21) and a second segment (22) extendable and retractable relative to the first segment (21) and equipped with a foot (20) for contact with the ground; first movement means (3) designed to rotate the arms (2) between a completely raised position and lowered working positions; second movement means designed to move the second segments (22) between a completely closed position and extended positions; and a processing unit configured to control the first and second movement means in such a way that the stabilizers (10) perform the following retraction sequence: rotating the arms (2) upwards to a first partially raised position; retracting the second segments (22) to a completely closed position; rotating the arms (2) upwards to the completely raised position, so that the stabilizers (10) are in the rest position.

23 Claims, 10 Drawing Sheets

(56) References Cited

U.S. PATENT DOCUMENTS

| | | | | |
|---|---|---|---|---|
| 6,227,569 | B1 * | 5/2001 | Dingeldein | B60S 9/10 212/304 |
| 6,802,687 | B2 * | 10/2004 | Litchfield | B66C 23/80 414/680 |
| 7,489,098 | B2 * | 2/2009 | Harris | B66C 23/80 212/277 |
| 9,394,667 | B2 * | 7/2016 | Iotti | B60S 9/02 |
| 9,834,423 | B2 * | 12/2017 | Magni | B66C 23/80 |
| 9,840,403 | B2 * | 12/2017 | Iotti | B66F 17/003 |
| 10,456,610 | B1 * | 10/2019 | Betz | E06C 7/182 |
| 2004/0131458 | A1 * | 7/2004 | Litchfield | E02F 9/24 414/680 |
| 2008/0019815 | A1 * | 1/2008 | Harris | B66C 23/80 414/563 |
| 2016/0024751 | A1 * | 1/2016 | Iotti | B66C 23/80 280/765.1 |
| 2016/0039648 | A1 | 2/2016 | Magni | |
| 2017/0106792 | A1 * | 4/2017 | McKee | B66F 9/0755 |
| 2018/0237275 | A1 * | 8/2018 | Iotti | B66C 23/80 |
| 2019/0010036 | A1 * | 1/2019 | Iotti | B66C 23/80 |

* cited by examiner

SYSTEM FOR STABILIZING SELF-PROPELLED OPERATING MACHINES

This invention relates to a system for stabilizing self-propelled operating machines, in particular telescopic handlers or "telehandlers".

There are prior art telescopic handlers, consisting of a vehicle equipped with a movable frame on wheels, which comprises a platform mounted on the frame, which in turn mounts the driver's cab and an operating arm which can be extended telescopically.

At the distal end of the arm there is an apparatus for lifting or moving loads, such as, for example, a fork, a cage, a lateral transfer unit, a hoist, etc.

In order to lift and move loads at great heights and with a significant "range" it is necessary to stabilize the vehicle, raising the wheels above the ground.

There are prior art stabilizers for telescopic handlers of the so-called "scissor lift" type, consisting of two stabilizing units, provided at the front and at the rear of the vehicle and mounted on its frame close to the wheels.

Each stabilizing unit comprises a pair of arms rotatable and extendable telescopically, usually with a single sliding member, which have respective distal ends, designed to be rested on the ground by means of supporting feet, and proximal ends, hinged to a supporting frame.

In practice, the stabilizing arms are positioned crossed relative to each other and, during the lifting, move like a pair of scissors.

Once the operations for moving the loads have been completed, the stabilizers are moved to the non-operating configuration in which they have the minimum overall dimensions, thus lowering the machine until resting the wheels on the ground.

The return of the known stabilizers to the non-operating configuration is carried out by performing the sequence of steps explained below.

The sliding members of the arms are partially retracted into the respective first segments until the wheels rest on the ground.

During this step, the sliding members protrude from the relative first segment or "sleeve" and are therefore still partly extracted.

At this point, the arms are rotated upwards in such a way as to be horizontal, parallel to each other; the sliding members are retracted completely only after the arms have reached the horizontal position, concluding the operations for recovery and enabling the operator to start the vehicle drive.

Although the prior art solution allows a correct recovery of the stabilizers, the sector has for some time felt the need to speed up this operation to allow a greater efficiency of use of the operating machines, which represent a limited resource since thy are notoriously very expensive and bulky.

In this context, the technical purpose which forms the basis of this invention is to propose a system for stabilizing self-propelled operating machines and a method for controlling stabilizing, which satisfy the above-mentioned need.

The aim specified is achieved by a method implemented according to claim 1 and by a system made according to claim 12.

Further features and advantages of this invention are more apparent in the non-limiting description of a preferred but non-exclusive embodiment of a system, as illustrated in the accompanying drawings, in which.

Figure 1:
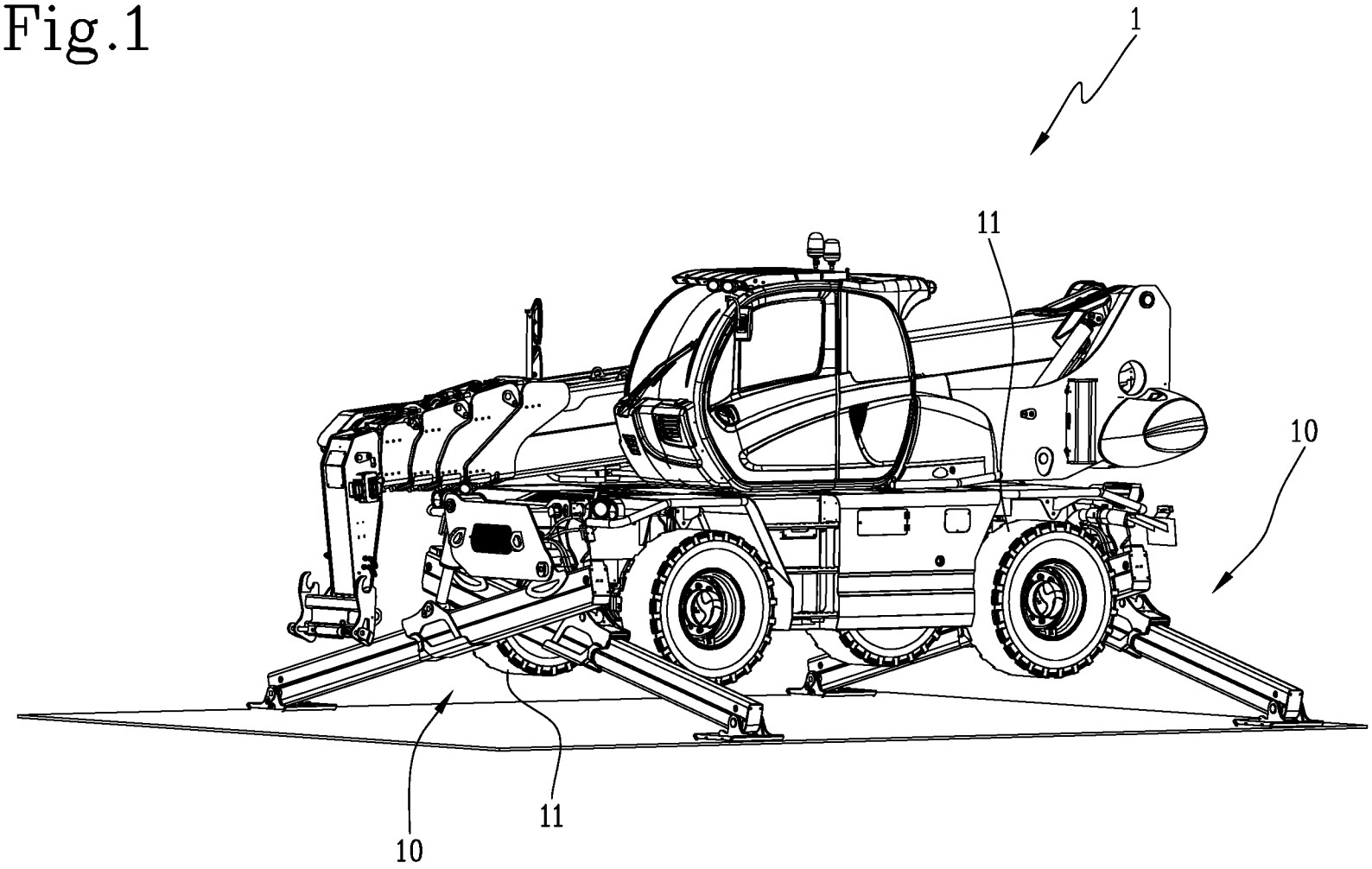
FIG. 1 is an axonometric view of a telehandler which includes the stabilizing system according to the invention.
Figure 2:
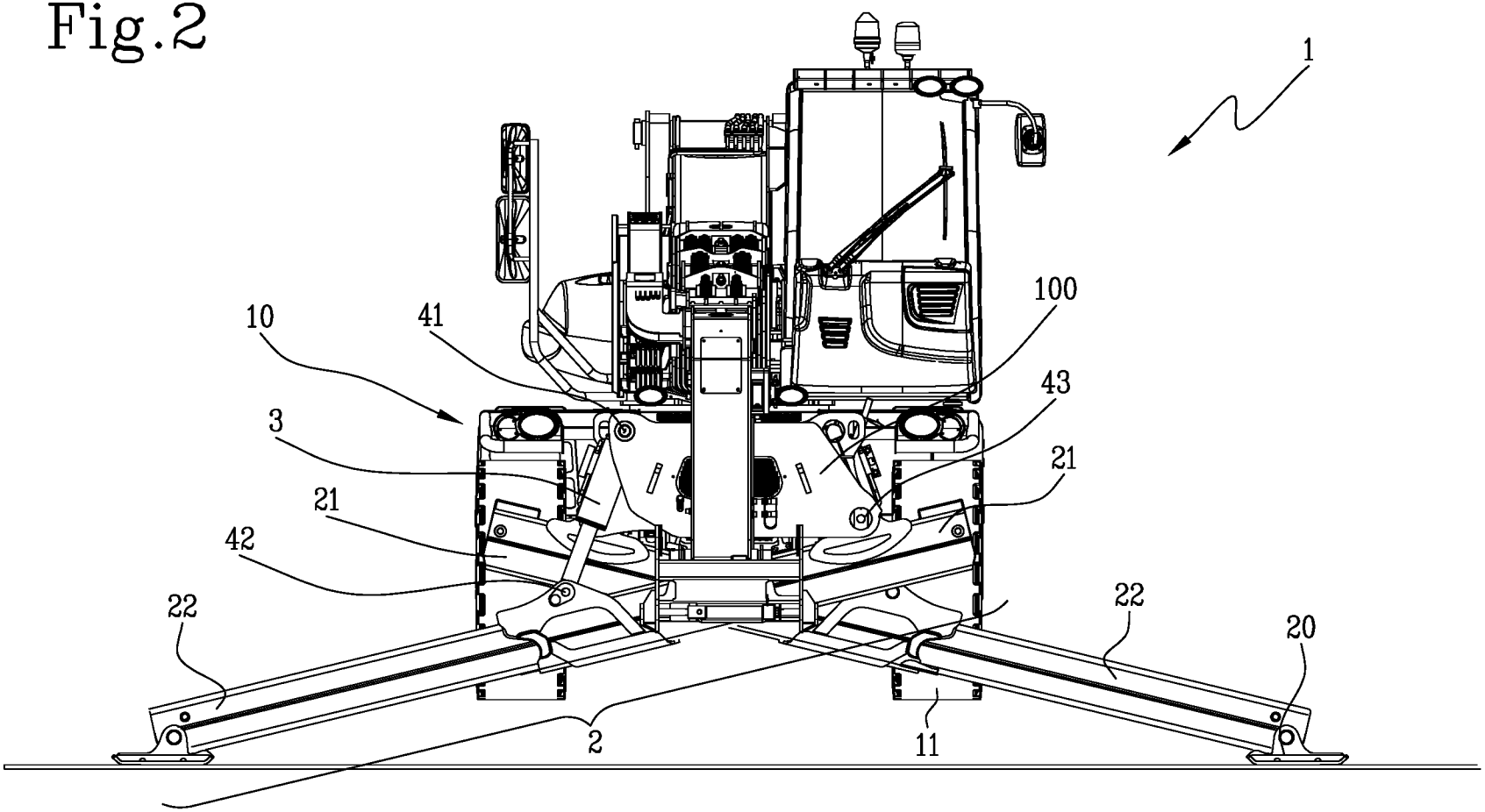
FIGS. 2-6 are front views of the machine of FIG. 1 which show different steps of the retraction sequence of the stabilizers included in the proposed system.

With reference to the accompanying drawings, the numeral 1 denotes in its entirety a vehicle comprising the system according to the invention.

More specifically, as shown in FIGS. 1-6, the system proposed has been especially conceived for implementation on a vehicle 1 consisting of a self-propelled operating machine such as a telehandler or an aerial platform, etc . . . and may be of the rotary type or even of the fixed type.

The system according to the invention includes stabilizers 10 designed to be mounted on the vehicle 1 and equipped with a plurality of stabilizing arms 2.

Preferably, the stabilizers 10 provided in the system according to the invention are of the so-called "scissor" or "X" type, and include two pairs of telescopic arms 2, for example with a single sliding member, located at the front and at the rear of the vehicle 1, in the proximity of the wheels 11.

More specifically, the stabilizers 10 include a supporting structure 100, fixed to or incorporated in the frame of the machine 1, to which the arms 2 of a pair are individually hinged, in a cross configuration, so as to be able to move in a counter-rotating fashion, like a pair of scissors.

Still more in detail, the two arms 2 connected to the same supporting structure 100 are mounted one in front of the other, so as to move in parallel planes, generically vertical.

The stabilizers 10 of the system proposed are designed to pass from operating configurations, wherein they stabilize the machine 1, raising the wheels above the ground, to a rest configuration, in which the wheels 11 are returned to the ground, and vice versa.

In practice, the stabilizing arms 2 are movable between a raised position, wherein they are distanced from the ground (see FIG. 6), and in particular freely allow the driving of the vehicle 1, and at least one lowered operating position (FIGS. 1 and 2), wherein they are rested on the ground to initiate the stabilization.

In practice, once the arms 2 are rested on the ground, the raising step starts which leads to the stabilizing of the vehicle 1.

In other words, the working position or position for resting the arms 2 is that of contact which starts the lifting thrust.

In fact, clearly, once the respective foot 20 is rested on the ground, the arms 2 does not lock in position but obviously continue the movement until they have raised the vehicle 1 and the desired stabilizing condition has been reached.

In general, a plurality of resting positions and a plurality of consequent stabilizing configurations is possible, depending on the specific conditions in which the vehicle 1 is to operate, with particular reference to the type of ground on which the machine 1 must stabilize.

In effect, depending on the slope or the shape of the ground on which the vehicle 1 stabilizes, the arms 2 may rest on the ground with variable inclinations and lengths.

As shown in the accompanying drawings, the arms 2 include a first segment 21, or "sleeve", which is hollow and in which is contained in a slidable fashion a second segment 22, or "sliding member", which is equipped, at the distal end, with a supporting element, that is, the above-mentioned foot 20.

In practice, each segment 21, 22 may comprise a rectilinear beam, which is hollow and with a quadrangular cross section.

In this case, the beam of the second segment 22 is inserted with the possibility of sliding in the beam of the first segment 21, which will obviously have a larger cross-section.

The invention comprises first movement designed to individually rotate the arms 2 between a completely raised position and lowered working positions.

Preferably, the first movement means comprise a hydraulic cylinder 3 for each arm 2.

More in detail, the first segment 21 of each arm 2 is connected to the supporting structure 100 by a first hinge 43; moreover, at the end of the movement of the arm 2 about the first hinge 43, use is made of the hydraulic cylinder 3, the thrust of which is used for lifting during the stabilizing step.

Each cylinder 3 is connected by a second hinge 41 to the supporting structure 100 and, through a third hinge 42, to the first segment 21 of the respective arm 2.

The first and the third hinge 42, 43 are positioned in two distinct points of the length of the sleeve 21, preferably at the upper side, the first being further inside, that is closer to the proximal end of the first segment 21, and the third further outside, that is, closer to the distal end.

In practice, the hydraulic cylinders 5 are actuated with a pushing action to move the arms 2 to the ground and raise the vehicle 1, whilst they are actuated with a retraction action when the vehicle 1 is returned to rest on the wheels and the arms 2 are raised in the rest position.

The invention includes second movement means, for example comprising hydraulic cylinders (not shown), designed to move individually the second segments 22 between a completely closed position and extended positions.

In practice, for the purpose of extending the sliding member 22 to the outside of the sleeve 21, use is made of a hydraulic cylinder, inserted between the sliding member 22 and the sleeve 21 and connected to each other at opposite ends.

The system according to the invention includes a processing unit, designed for adjusting the movements of the stabilizers 10, as described in more detail below.

Generally speaking, it should be noted that, in this description, the processing unit is presented as divided into separate functional modules for the purpose of describing the functions clearly and completely.

In practice, the processing unit may consist of a single electronic device, also of the type commonly present on this type of machine, suitably programmed to perform the functions described; the various modules can correspond to hardware units and/or software forming part of the programmed device.

Alternatively or in addition, the functions can be performed by a plurality of electronic devices on which the above-mentioned functional modules can be distributed.

Generally speaking, the processing unit may have one or more microprocessors for execution of the instructions contained in the memory modules and the above-mentioned functional modules may also be distributed on a plurality of local or remote calculators based on the architecture of the network on which they are housed.

Figure 4:
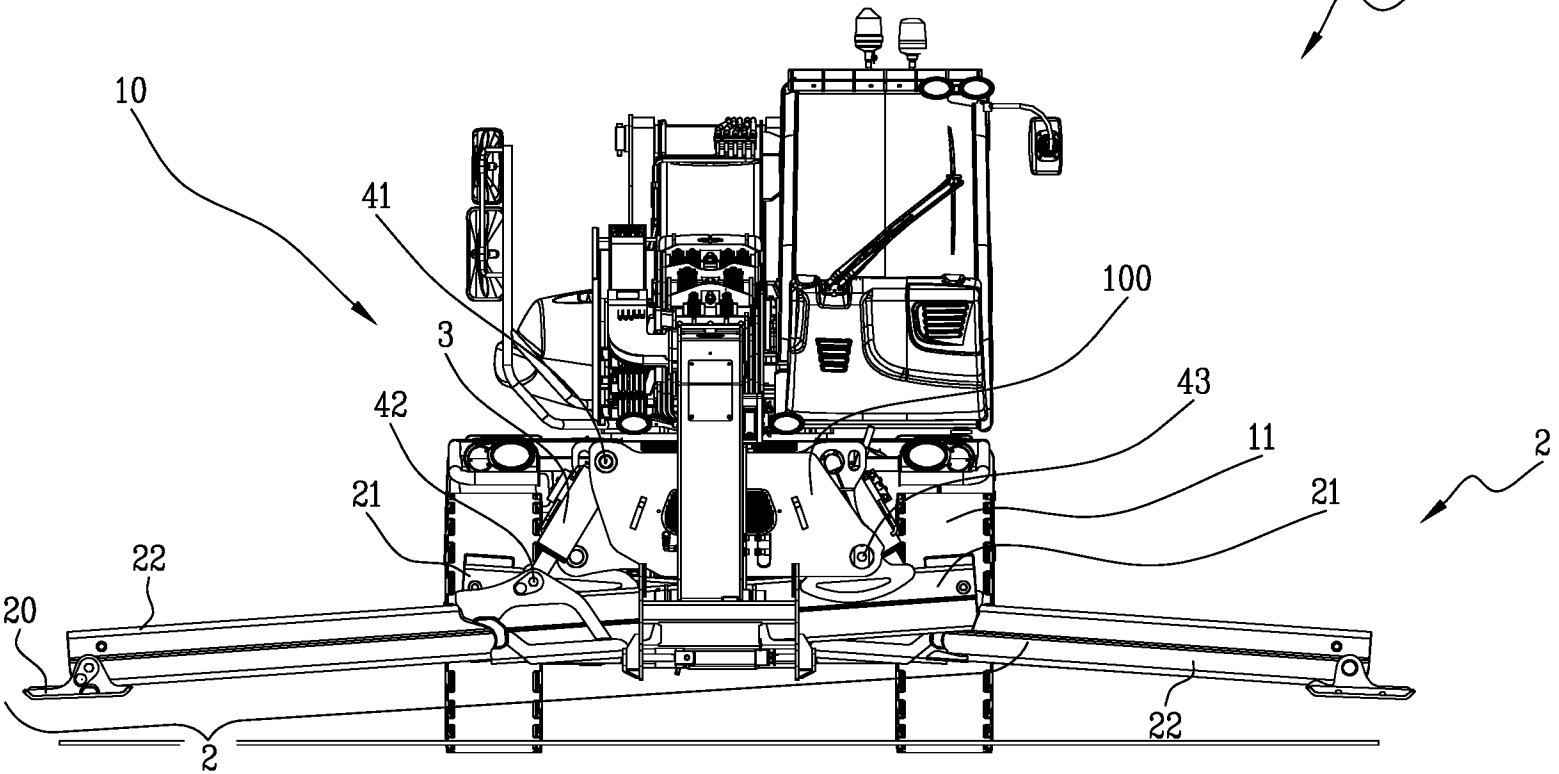
Figure 5:
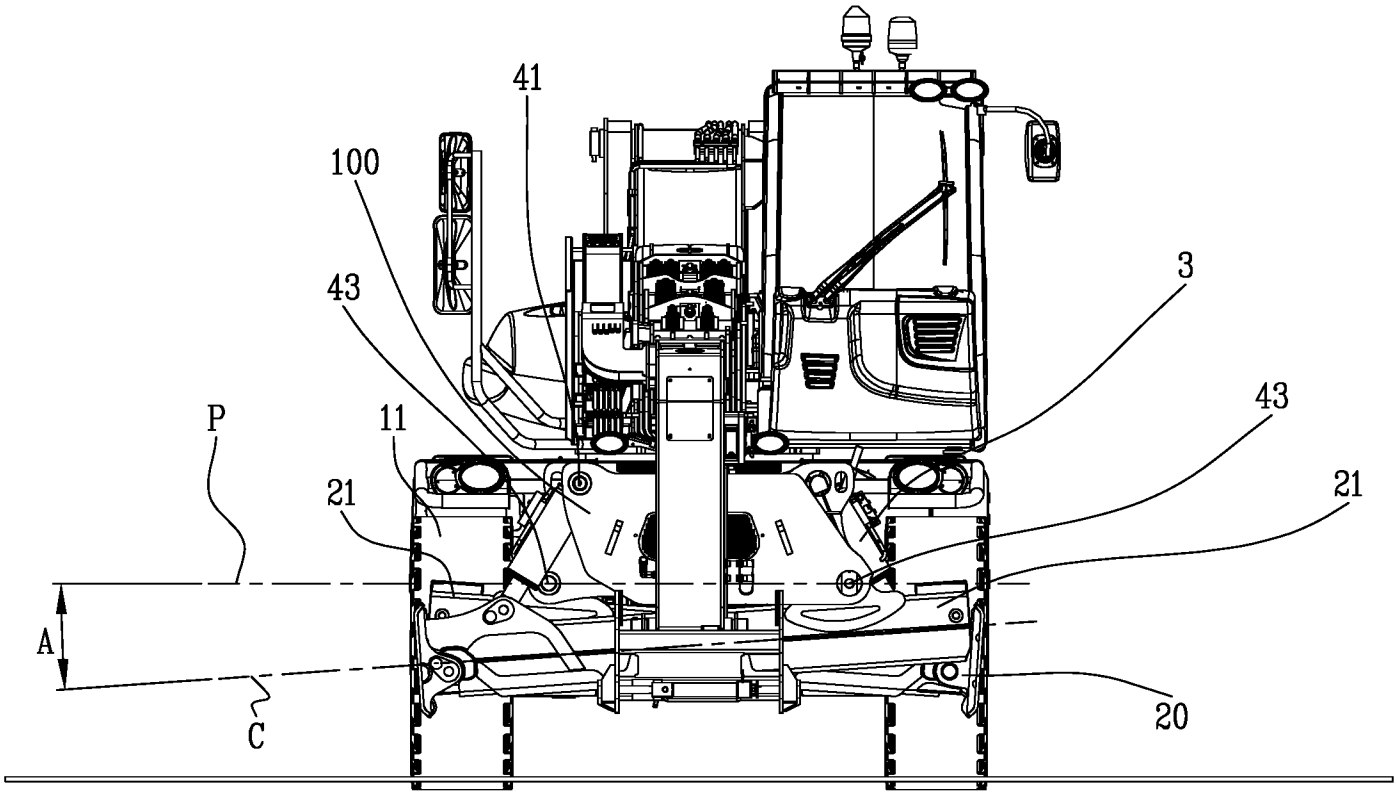

According to an important aspect of the invention, the processing unit is configured to control the above-mentioned first and second movement means in such a way that the stabilizers 10 carry out the following retraction sequence, starting from a working configuration in which the machine is stabilized (see FIG. 2):

rotating the arms 2 upwards to a first partially raised position (illustrated in FIGS. 4 and 5);

retracting the second segments to a completely closed position (FIG. 5); and rotating the arms 2 again upwards into the completely raised position (FIG. 6), so that the stabilizers 10 are in the rest position, referred to above.

Figure 3:
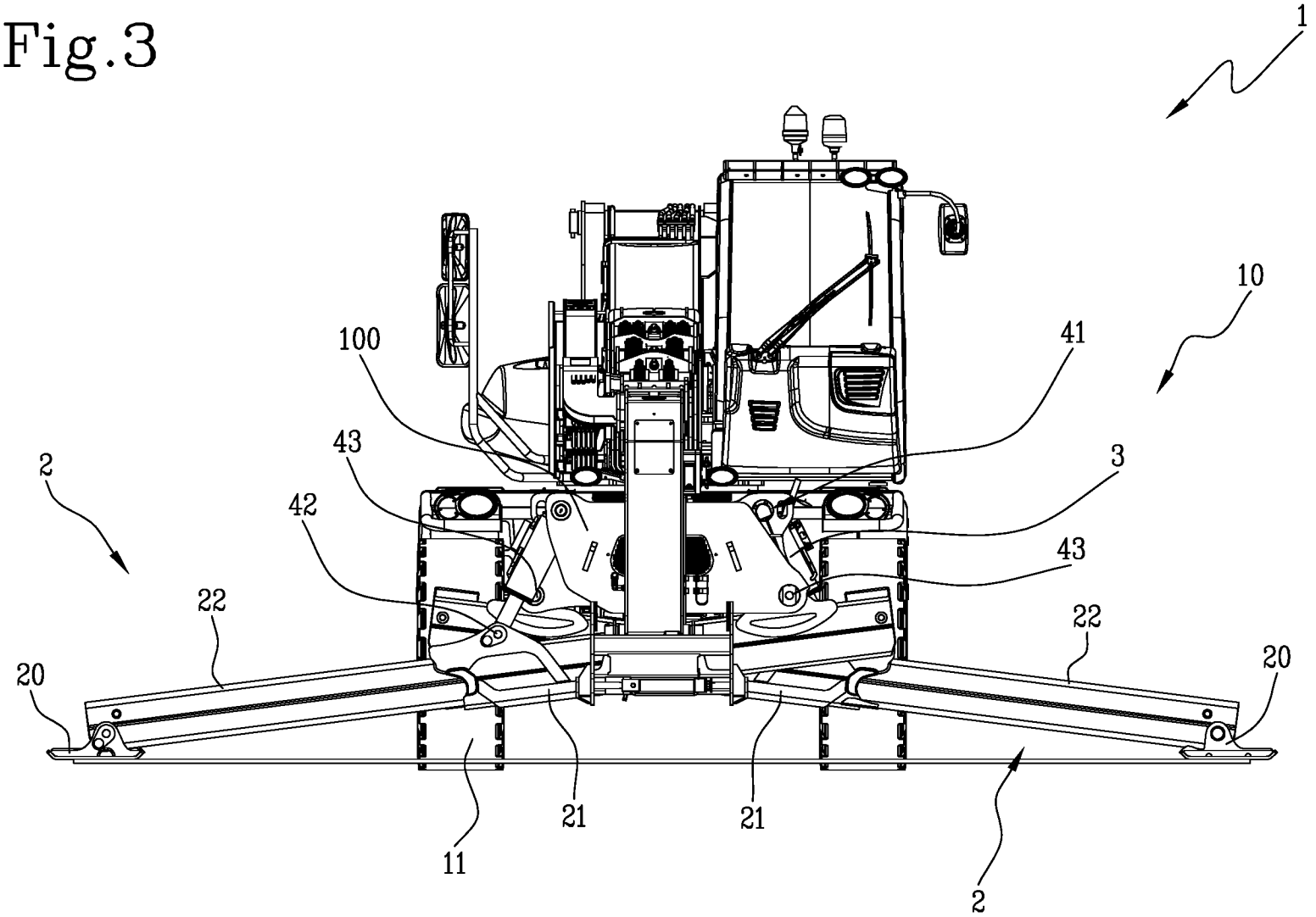

More in detail, as shown in FIG. 3, the rotation of the arms 2 to the first partial position is achieved by initially rotating the arms 2 up to a second partially raised position, lower than the first position, where the wheels of the machine are rested, and the rotation then continues up to the above-mentioned first position.

In the second partially raised position, the feet can still be in contact with the ground.

Preferably, in the completely raised position, the arms 2 are substantially horizontal and parallel to each other, whilst in the partially raised position they are crossed.

It should be noted that, preferably, the arms 2 of both the pairs move together, even though this does not exclude solutions in which the arms 2 can have off-set movements, providing the above-mentioned sequence is complied with.

It may be seen that the invention comprises a retraction sequence of the stabilizer 10 which is significantly different from that used with the prior art systems.

In effect, whilst in prior art systems, the complete retraction of the second segments in the first segments only occurs after the arms 2 have been moved to a horizontal position, the invention comprises a sequence of retraction wherein the second segments move to their position of minimum length, therefore with complete retraction, when the arms 2 are still in a partial retraction position; only after the sliding members are retracted do the arms 2 complete the rotation upwards to the final position of rest.

For this reason, in the first partially raised position, the arms 2 are still crossed and oblique relative to a horizontal reference plane, which, for example, can be identified as the plane passing through the four first hinges of the four stabilizing arms mounted on the operating machine.

More generally speaking, in the first partially raised position, the arms 2 are set at an angle A different from zero relative to an ideal plane P integral to the supporting structure 100 mentioned several times above (see FIG. 5).

The ideal plane P is generically "horizontal" or it can be defined as a plane in which the second segments of the arms 2 lie in their completely raised position, or a plane parallel to them.

Preferably, the above-mentioned angle A is equal to 4°, although, as will be explained in more detail below, the invention can operate perfectly even with a different inclination.

It should be noted that when in this description the adjective "horizontal" is used or reference is made to "horizontal planes, it is used to refer to the horizontality in the case of flat and horizontal ground.

In fact, it is clear that if the ground on which the wheels 11 or stabilizers 10 rest is not regular or is inclined, the "horizontal" reference is inclined accordingly.

Moreover, when this description refers to the angles formed by the arms 2 relative to the reference plane P and more generally speaking their inclination, reference is made to the angle formed by the central longitudinal axis C of the arm 2 and, more precisely, of its first segment 21.

It can already be understood from the above description how the invention overcomes the limitations of the prior art discussed in the introduction.

In effect, since retraction of the sliding members 22 in the respective sleeve 21 is performed before the arms 2 are moved to the rest position, thus eliminating the lateral dimensions of the extended sliding members, the operator can start the drive manoeuvres before the total retraction of the stabilizers 10 has occurred, in compliance with safety regulations of the sector.

For this reason, the invention allows an improvement in efficiency of use of the self-propelled operating machine.

The processing unit is connected to the commands located in the cabin of the machine, in such a way that the operator can operate the stabilizers 10 by means of a joystick or other commands.

In practice, acting continuously on a command, for example a joystick, a lever or the like, the stabilizing arms perform the retraction sequence predetermined by the processing unit; in this case, the operator can interrupt the sequence, for safety reasons, simply by releasing the command.

Alternatively, the sequence of movements of the arms 2 may be fully automatic and be initialised by pressing a pushbutton, or by using a touch screen display or by using a voice command, etc.

More specifically, the proposed system preferably comprises the use of an electro-hydraulic distributor which controls the above-mentioned cylinders 5 that move the arms 2 in rotation and elongation (or retraction).

The distributor is designed to adjust the operation of the cylinders 5 of the stabilizers 10, as a function of control signals arriving from the processing unit.

The control signals are produced in a sequence predetermined by the processing unit and are designed to move the hydraulic cylinders in the stabilizing arms 2 in such a way as to perform the retraction sequence described above.

The invention may include first detecting means 51, 52, connected to the processing unit and designed to measure the inclination of the arms 2 relative to the above-mentioned reference plane P.

Moreover, the invention may include second detecting means (not illustrated), connected to the processing unit and designed to measure the length of the part of second segment 22 that is projecting with respect to the respective first segment 21.

More in detail, according to the preferred embodiment of the invention, shown in the accompanying drawings, the first detecting means include, for each arm 2, an indicating element 51 integral with it and also comprise one or more control sensors for 52 for detecting the indicating element.

More specifically, the indicating element 51 is configured in such a way that its detection by the sensor represents the fact that the respective arm 2 has reached the above-mentioned first partially raised position (shown in FIG. 5).

The sensors 52 are designed to produce an inclination signal as a function of the measurements taken, transmitted to the processing unit which controls the hydraulic distributor in accordance with the inclination signals received.

Still more in detail, each indicating element 51 is fixed to the first segment 21 of the respective arm 2 and, for each indicating element 51, there is a proximity sensor 52 mounted on the supporting structure 100, arranged in such a way that its area of detection superposes the path along which the indicating element 51 moves.

For example, the indicating element may comprise a shaped plate 51, projecting from the upper side of the first segment 21 and having dimensions such that its detection by the relative sensor 52 represents the fact that the arm 2 has reached its partially raised position, for example inclined at 4° relative to the reference plane, so that the processing unit completely retracts the second segment 22 in the first segment 21.

In one particular embodiment, the indicating element may also be shaped and dimensioned in such a way as to allow checking if the arms 2 are in the above-mentioned completely raised position, in which the retraction is completed.

In the construction example shown in FIGS. 7-10, the supporting structure 100 comprises, for each indicating element 51, a through hole 101 designed to receive the element 51, formed in its lower wall; in this case, the proximity sensor 52 may be mounted above the upper surface of the wall and positioned in front of the hole 101, to allow detection of the free end of the indicating element 51 which protrudes from the hole 101, during the recovery of the stabilizers 10.

Alternatively or in addition, the first measuring detecting means can comprise a position sensor for each arm 2, mounted on the upper side of the first segment 21 and designed to measure the distance relative to the above-mentioned lower wall of the supporting structure 100 or, vice versa, it may be mounted on the lower surface of the structure and perform the same function.

In any case, on the basis of the relative position of the position sensor 52 and the distance from it measured, it is possible to determine the inclination of the arm 2, that is to say, the angle formed by the first segment 21 and the reference plane P, which in this case may also be the plane on which the lower wall of the supporting structure 100 lies, or a plane parallel to it.

Various solutions may be provided to determine when the second segments 22 are in their complete closed position.

For example, each second segment 22 may comprise a non-extendable cable wound on a reel connected to a sensor, such as, for example, an encoder or other angular position transducer.

Alternatively, position sensors may be used which measure the distance of a fixed reference to the second segment 22 relative to the first segment 21 and so on.

In any case, whatever sensor is used, it is designed to generate an extension signal, representing the position of the second segment 22 relative to the first segment 21, the signal being transmitted to the processing unit which, according to the signals received, controls the distributor so that it actuates the hydraulic cylinders in such a way as to follow the retraction sequence according to the invention.

More precisely, the sensors of the second detecting means are designed to check when the second segments 22 are in the completely closed position (shown in FIGS. 5 and 6) which corresponds to the minimum length of the arms allowed and, consequently, to the condition wherein the stabilizers 10 define the minimum lateral dimensions of the machine 1 on which they are mounted.

It should be noted that the complete closing position is the position of minimum extension, or maximum retraction, of the second segment 22 and, according to some versions of the invention, may correspond to the condition of a protruding part of the second segment 22 with zero length, with the feet 20 in contact with the distal ends of the first segment 21; in other versions it may, on the other hand, correspond to a condition of the protruding part of the second segment 22 with a minimum length not zero, that is, without contact between the feet 20 and the first segment 21.

According to the preferred embodiment of the invention, the processing unit comprises an inclination module configured for verifying whether the arms 2 are in the first partially raised position, in which they are inclined with respect to the reference plane by a first retraction angle A, or in the completely raised position, in which they are inclined by a second retraction angle.

In practice, by comparing the inclination signals with predetermined values of the first and second angle, the processing unit is able to establish whether or not and when the arms 2 are in the first partial raising position or in the complete raising position.

Preferably, the second retraction angle is zero, which corresponds to the case in which, in the rest configuration of the stabilizers 10, the arms 2 and in particular the first segments are horizontal, therefore parallel to the reference plane P or lying on it.

The first angle A is greater than zero degrees and can be less than 10°, preferably between 0.1° and 6° and, still more preferably, between 0.1° and 4° and, still more in detail, is substantially equal to 4°.

In their first partially raised position, the arms 2 are crossed, that is to say, they are not parallel.

The processing unit may also comprise an extension module, configured for verifying whether the second segments 22 are in the relative completely closed position, in which they have a predetermined retraction length, which may be zero (apart from the foot) or not zero.

In practice, in the completely closed position, the second segment 22 may be completely inserted in the first segment 21, with the foot 20 which clearly remains outside, or the second segment may protrude from the first by a predetermined length; in both cases, the extension module receives from the sensor of the second detection means a signal whose length represents the completely closed state of the relative second segment 22.

It should be noted that the processing unit comprises a memory module in which are recorded control parameters as a function of the first angle A, the second angle and the predetermined length.

Moreover, the processing unit may include a user interface configured to allow an operator to select or set up the control parameters.

The preferential operation of the invention is described below.

Once the planned operations have been concluded, during which the machine 1 has been stabilized, the operator in the cabin starts the steps for retraction of the stabilizers 10, using a special command.

As mentioned, the stabilizing arms 2 move in a synchronised fashion and, more specifically, all four simultaneously.

Initially, the arms 2 raise by means of the rotation of the first segments 21 upwards, so that the wheels 11 first touch the ground (condition corresponding to that referred to above as the second partially raised position; FIG. 3), and then continue until reaching the first partially raised position, determined by the control parameter representing the first above-mentioned angle A (FIG. 4).

In practice, to obtain this, the hydraulic cylinders 5 located between the first segments 21 and the supporting structure 100 are actuated in retraction fashion so as to rotate the arms 2 to a position in which the proximity sensors 52 "see" the indicating elements 51.

At this point, the arms 2 are shortened, until the sensors of the second detecting means signal to the processing unit that the second segments 22 have reached the relative completely closed position, determined on the basis of the respective control parameter stored (see FIG. 5).

Figure 6:
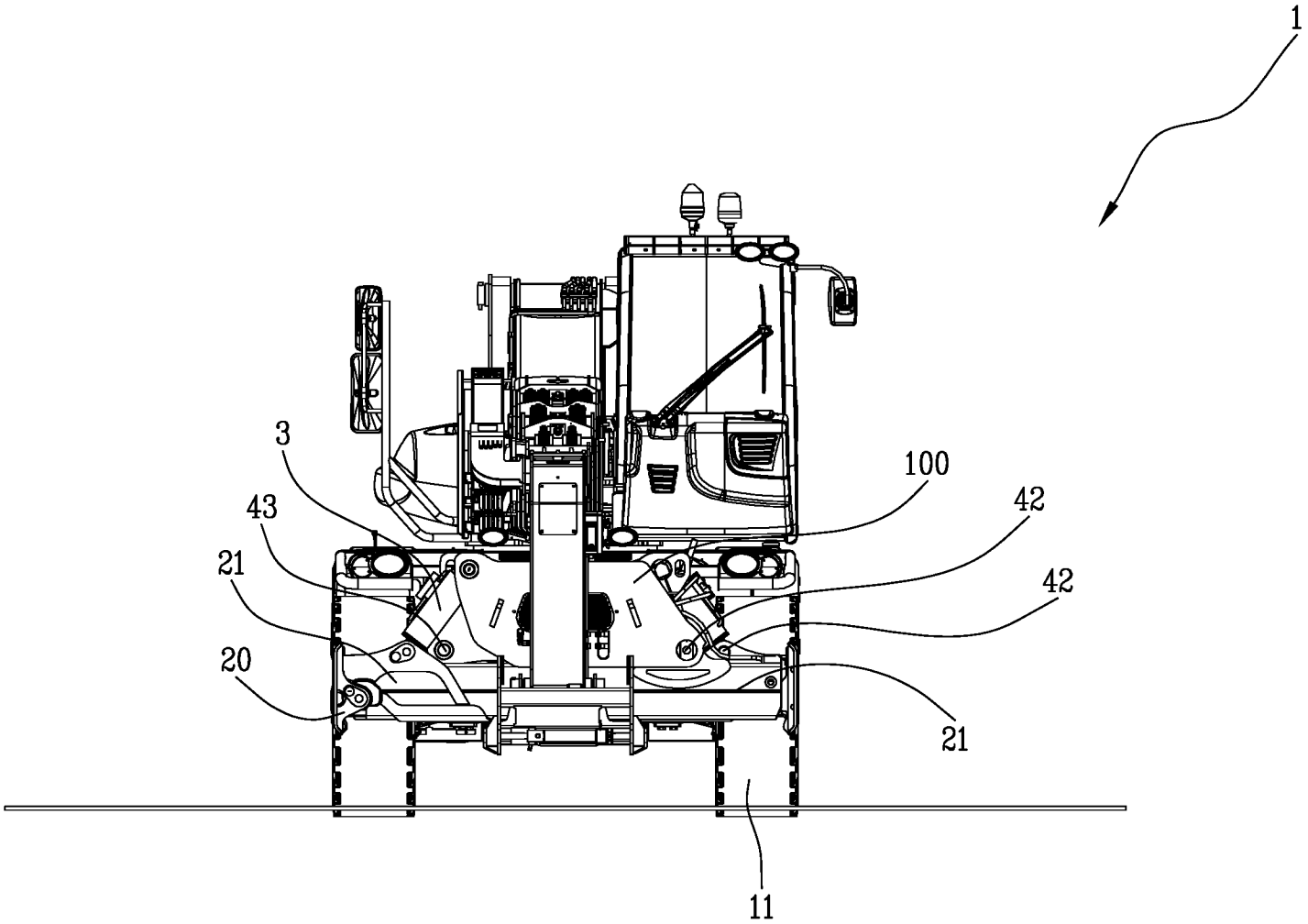
Figure 7:
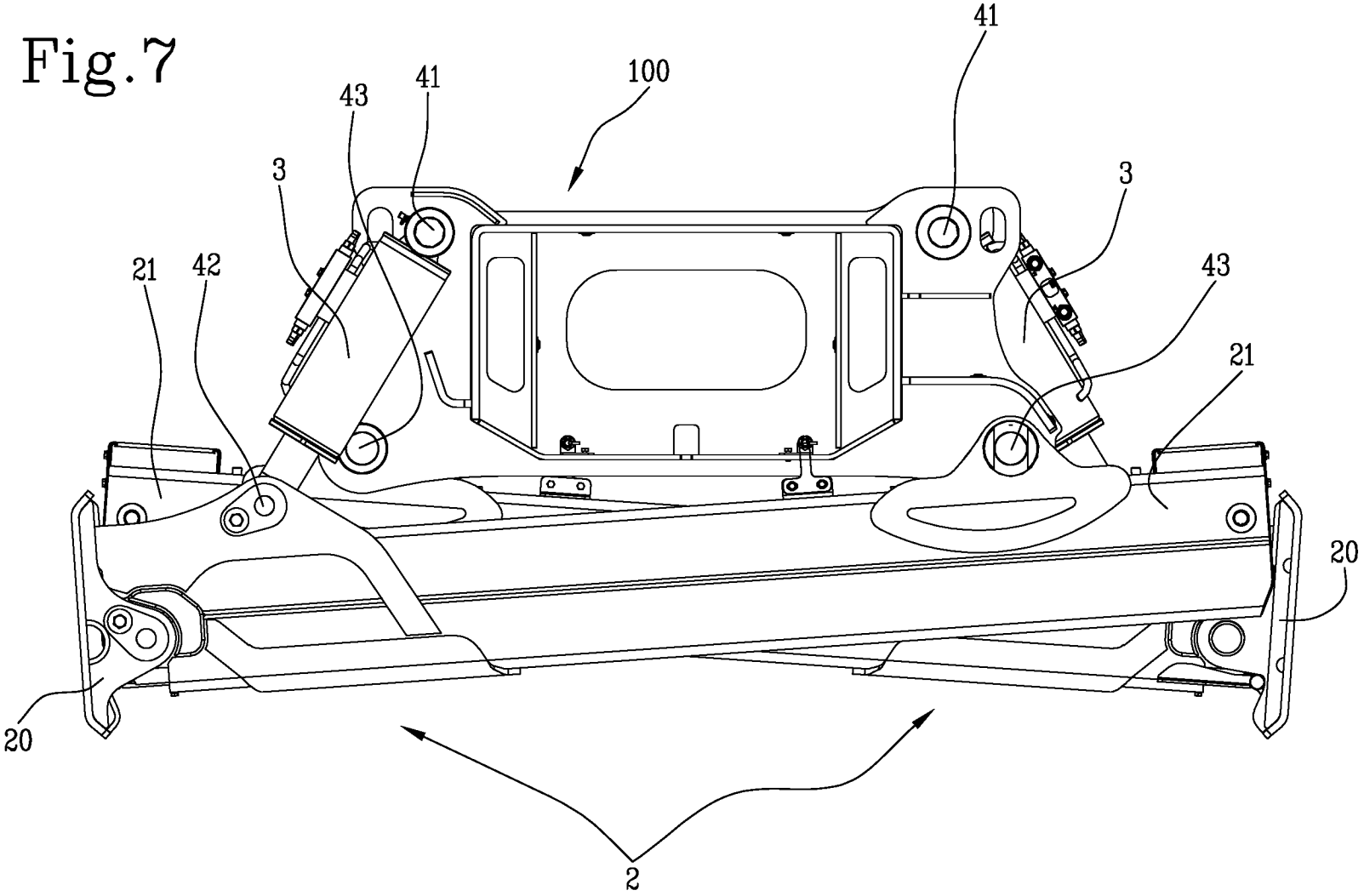
FIG. 7 is a front view of a stabilizing unit which includes one of the two pairs of stabilizing arms which are provided in the system according to this invention.
Figure 8:
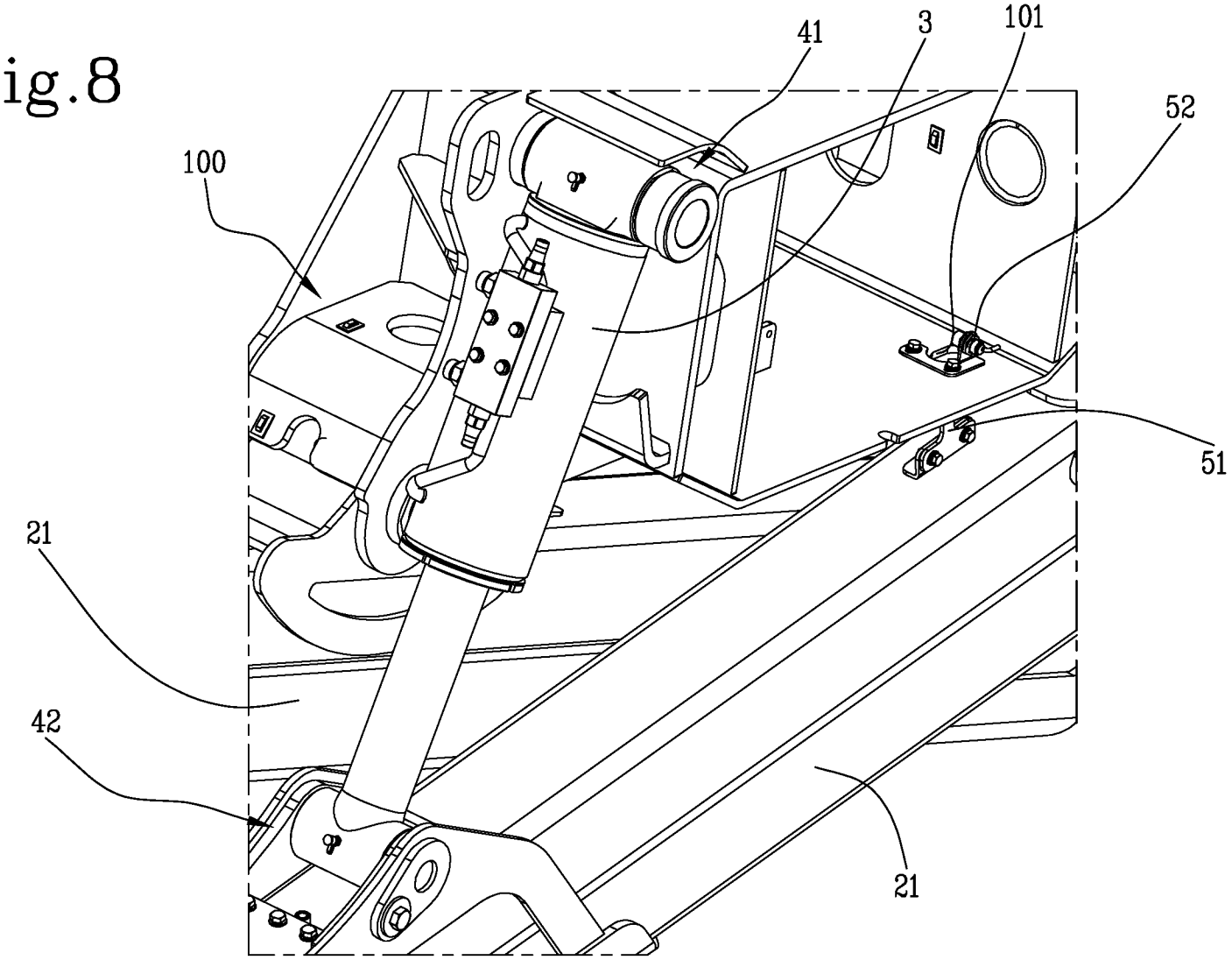
FIGS. 8-10 are axonometric views of details concerning detecting means connected to a processing unit according to the invention.
Figure 9:
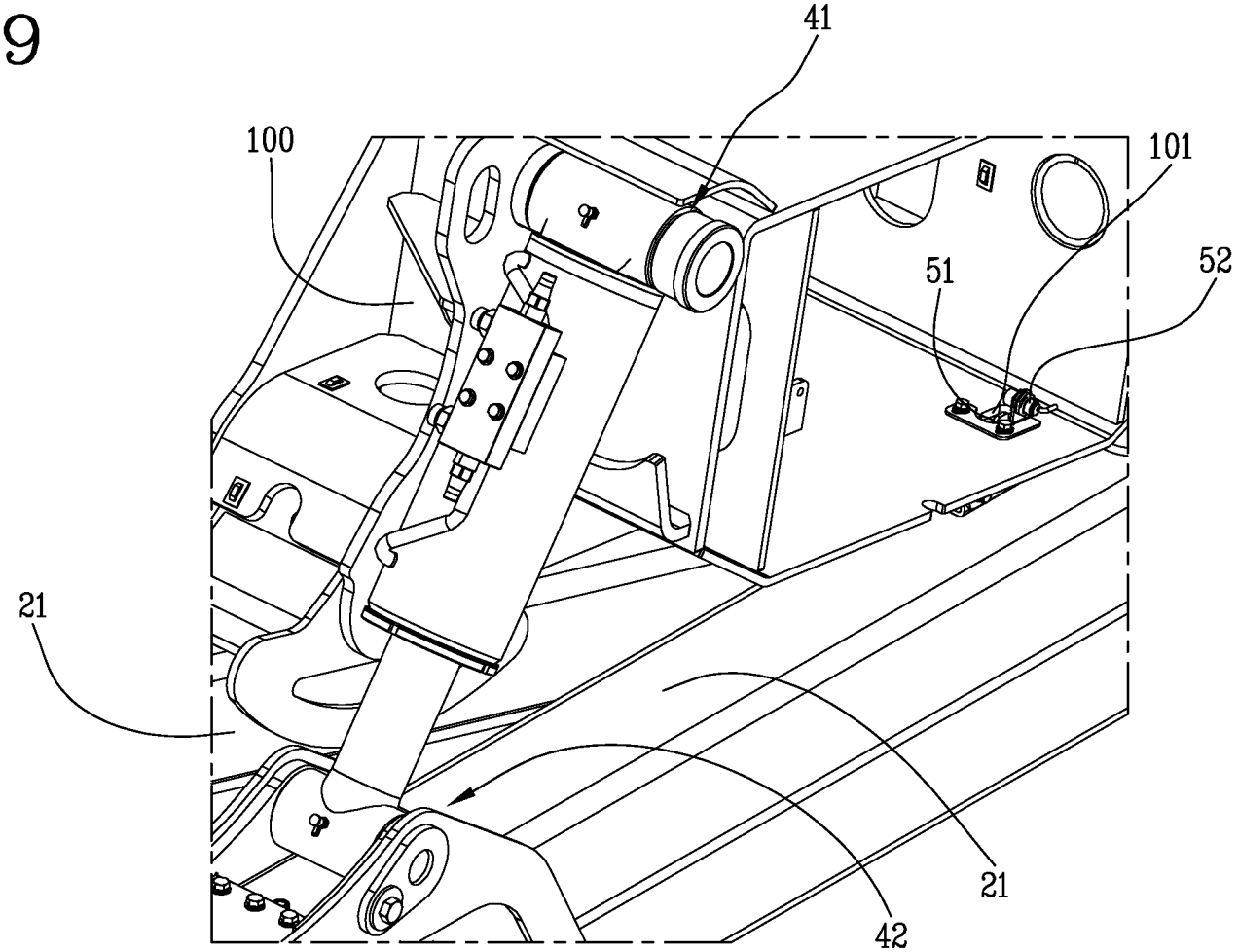
Figure 10:
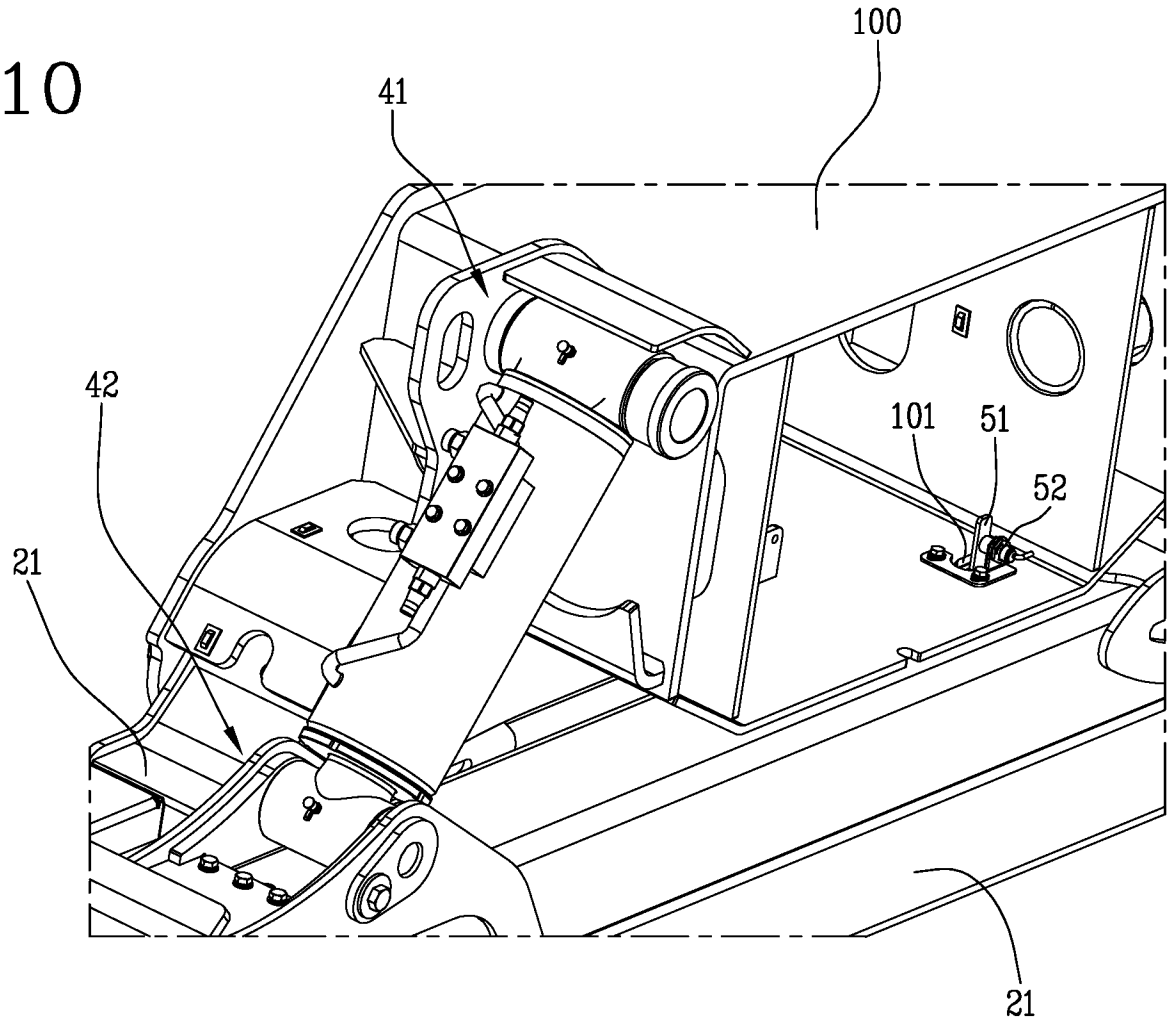

Only after this step, the first segments are rotated again to the completely raised position, in which the retraction of the stabilizers 10 is concluded (FIG. 6).

The invention is also configured as a method for controlling scissor-like stabilizers 10 of self-propelled operating machines 1 which can be actuated by means of the system described above.

According to the proposed method, starting from a working configuration of the stabilizers 10 (FIGS. 1 and 2), in which wheels of the machine 1 are raised from the ground surface and the arms 2 are oblique with respect to the ground, with the relative second segments in a first extended position and with the relative feet resting on the ground surface, the stabilizers 10 are brought to the rest configuration (FIG. 6), by means of the following sequence of steps:

rotating the arms 2 upwards to the first partially raised position;

retracting the second segments to the completely closed position; and rotating the arms 2 again upwards to a completely raised position.

It should be noted that the method according to the invention may comprise steps which correspond to the functions performed by the various components of the proposed stabilizing system.

In detail, the rotation of the arms 2 to the first partial position is achieved by initially rotating the arms 2 to a second partially raised position, lower than the first position, wherein the feet still rest on the ground, thereby allowing the resting of the wheels 11 of the machine 1, after which the arms 2 rotate to the first position.

Moreover, in the completely raised position, the arms 2 are horizontal and parallel to each other whilst in the first partially raised position the arms 2 are crossed relative to each other, with the respective feet 20 distanced from the ground.

In the first partially raised position the arms 2 are inclined by a non-zero angle A relative to the completely raised position; the angle may be less than or equal to 10 degrees and more specifically between 0.1 and 6 degrees.

Preferably, the angle A of the first partially raised position is between 0.1 and 4 degrees and, still more preferably, is equal to 4°.

Moreover, in the completely closed position of the second segments the arms 2 have a minimum length, so that the stabilizers 10 define the minimum lateral dimensions of the machine.

When they are in the completely raised the arms 2 define a configuration of the stabilizers 10 wherein they have the maximum distance relative to the ground, that is to say, the minimum dimensions in height.

Moreover, the invention is configured also as a computer program which, running on an electronic processing unit, implements the steps of the proposed method.

The invention claimed is:

1. A method for controlling scissor stabilizers (10) of self-propelled work machines (1), such as telescopic handlers or the like, of a type comprising one or more pairs of rotatable telescopic stabilizing arms (2), each arm (2) comprising a first segment (21) and a second segment (22) extensible and retractable with respect to said first segment (21) and provided with a foot (20) for contact with a ground surface, wherein from a working configuration of the stabilizers (10), in which wheels (11) of said machine (1) are raised from the ground surface, with the relative second segments (22) in a first extended position and with the relative feet (20) resting on the ground surface, the stabilizers (10) are brought into a rest configuration by means of the following sequence of steps:

rotating the arms (2) upwards into a first partially raised position;

retracting the second segments (22) into a completely closed position; and rotating the arms (2) upwards into a completely raised position.

2. The method according to claim 1, wherein the rotation of the arms (2) up to the first partial position is achieved by initially rotating the arms (2) up to a second partially raised position, lower than the first position, thus enabling a resting of the wheels (11) on the ground surface, then rotating the arms (2) up to the first position.

3. The method according to claim 1, wherein in the completely raised position, the arms (2) are parallel to one another.

4. The method according to claim 1, wherein in the first partially raised position, the arms (2) are crossed with respect to one another.

5. The method according to claim 1, wherein in the first partially raised position of the arms (2), the relative feet (20) are distanced from the ground surface.

6. The method according to claim 1, wherein in the first partially raised position, the arms (2) are inclined by a non-zero angle (A) that is less than or equal to 10 degrees with respect to the completely raised position.

7. The method according to claim 6, wherein in the first partially raised position, the arms (2) are inclined between 0.1 and 6 degrees with respect to the completely raised position.

8. The method according to claim 7, wherein in the first partially raised position, the arms (2) are inclined between 0.1 and 4 degrees with respect to the completely raised position.

9. The method according to claim 8, wherein in the first partially raised position, the arms (2) are inclined substantially by 4 degrees with respect to the completely raised position.

10. The method according to claim 1, wherein in the completely raised position, the arms (2) are horizontal.

11. The method according to claim 1, wherein in the completely closed position of the second segments, the arms (2) have a minimum length.

12. The method according to claim 1, wherein in the completely raised position, the stabilizers (10) are at a maximum distance from the ground surface.

13. A computer program which, when run on an electronic processing unit, carries out the steps of the method according to claim 1.

14. A stabilizing system for a self-propelled work machine (1), such as a telescopic handler or the like, comprising scissor stabilizers (10), able to pass from working configurations, in which they stabilize the machine (1), by raising the wheels (22) of the machine (1) from the ground surface, to a rest configuration, in which said wheels (11) are brought down to the ground surface, in turn comprising:

one or more pairs of rotatable stabilizing telescopic arms (2), each arm (2) comprising a first segment (21) and a second segment (22), extensible and retractable with respect to said first segment (21), and provided with a foot (20) for contact with a ground surface;

first movement means (3) able to rotate the arms (2) between a completely raised position and lowered working positions;

second movement means able to move the second segments (22) into a completely closed position and extended positions; and a processing unit configured for controlling said first and second movement means in such a way that the stabilizers (10) carry out the following retraction sequence:

rotating the arms (2) upwards into a first partially raised position;

retracting the second segments (22) into a completely closed position; and rotating the arms (2) upwards into a completely raised position, so that said stabilizers (10) are in said rest position.

15. The system according to claim 14, wherein the stabilizers (10) comprise, for each pair of arms (2), a support structure (100) fixable to the frame of the machine (1), to which the first segments (21) are hinged, in which the relative second segments (22) are slidably inserted, wherein the system comprises:

first detecting means (51, 52), connected to said processing unit and able to measure the inclination of each arm (2) with respect to a reference plane (P) that is fixed with respect to said structure (100);

second detecting means, connected to the processing unit and able to measure the length of a part of each second segment (22) that is projecting with respect to the respective first segment (21);

an inclination module, included in the processing unit, configured for verifying whether the arms (2) are in said first partially raised position, in which they are inclined by a first retraction angle (A) and for verifying whether the arms (2) are in said completely raised position, in which they are inclined by a second retraction angle; and an extension module, included in the processing unit, configured for verifying whether the second segments (22) are in the completely closed position, wherein the relative projecting parts have a predefined retraction length.

16. The system according to claim 15, wherein said reference plane (P) is substantially horizontal.

17. The system according to claim 15, wherein said second retraction angle is substantially zero.

18. The system according to claim 15, wherein said first retraction angle (A) is between 0.1 and 10 degrees.

19. The system according to claim 15, wherein said first retraction angle (A) is between 0.1 and 4 degrees.

20. The system according to claim 15, wherein said first retraction angle (A) is substantially 4 degrees.

21. The system according to claim 14, wherein said first detecting means comprise, for each arm (2), an indicating element (51) solid thereto and further comprise one or more control sensors (52) for detecting said indicating element (51).

22. The system according to the preceding claim 21, wherein said indicating element (51) is fixed to the first segment (21) of the relative arm (2) and wherein a control sensor (52) for each arm (2) is mounted on said support structure (100), arranged so as to control the position of the relative indicating element (51).

23. A self-propelled work machine (1), such as a telescopic handler or the like, comprising a stabilizing system according to claim 14.

* * * * *